United States Patent [19]

Yokoya et al.

[11] Patent Number: 4,800,146

[45] Date of Patent: Jan. 24, 1989

[54] TRANSPARENT ELECTROPHOTOGRAPHIC PHOTORECEPTOR COMPRISING SPECIFIC HYDRAZONE AND BENZIDINE COMPOUNDS AS PHOTOCONDUCTORS

[75] Inventors: Hiroaki Yokoya; Kenji Sano; Hiromichi Tachikawa; Hideo Sato, all of Kanagawa, Japan

[73] Assignee: Fuji Photo Film Co., Ltd., Kanagawa, Japan

[21] Appl. No.: 929,315

[22] Filed: Nov. 12, 1986

[30] Foreign Application Priority Data

Nov. 11, 1985 [JP] Japan ..... 60-252516

[51] Int. Cl.[4] ..... G03G 5/06

[52] U.S. Cl. ..... 430/73; 430/74

[58] Field of Search ..... 430/73, 74

[56] References Cited

U.S. PATENT DOCUMENTS 4,301,226 11/1981 Contois et al. ..... 430/74

*Primary Examiner*—J. David Welsh

*Attorney, Agent, or Firm*—Sughrue, Mion, Zinn, Macpeak & Seas

[57] ABSTRACT

A transparent electrophotographic photoreceptor comprising a conductive support having provided thereon a photosensitive layer is disclosed, wherein said photosensitive layer contains a combination of at least one of specific hydrazone compounds and at least one of specific benzidine compounds as photoconductive substances. These photoconductive substances are prevented from crystallization and precipitation on the surface of the photoreceptor so that the photoreceptor exhibits satisfactory stability before and after image formation even when preserved for long periods of time or under a high temperature condition.

13 Claims, No Drawings

TRANSPARENT ELECTROPHOTOGRAPHIC PHOTORECEPTOR COMPRISING SPECIFIC HYDRAZONE AND BENZIDINE COMPOUNDS AS PHOTOCONDUCTORS

FIELD OF THE INVENTION

This invention relates to a transparent electrophotographic photoreceptor. More particularly, it relates to an electrophotographic photoreceptor comprising a conductive support having provided thereon a photosensitive layer containing a specific hydrazone compound and a specific benzidine compound.

BACKGROUND OF THE INVENTION

In electrophotography, photoconductive substances for photoreceptors include inorganic substances, such as selenium, cadmium sulfide, zinc oxide, and the like. It is, however, very difficult to form flexible electrophotographic photoreceptors by using these inorganic photoconductive substances. Therefore, organic photoconductive substances should be used for obtaining flexible electrophotographic photoreceptors. Such organic compounds conventionally proposed include poly-N-vinylcarbazole sensitized with pyrylium salt dyes as disclosed in Japanese patent publication No. 256258/73; photoreceptors comprising poly-N-vinyl-carbazole and 2,4,7-trinitrofluoren-9-one as disclosed in U.S. Pat. No. 3,484,237; arylamine photoconductive compounds sensitized with pyrylium salt dyes as disclosed in U.S. Pat. No. 3,141,770; photoreceptors mainly comprising an eutectic complex composed of a dye and a resin as disclosed in Japanese patent application (OPI) No. 10735/72 (the term "OPI" as used herein means "unexamined published patent application"); and the like. Although such photoreceptors possess excellent electrophotographic characteristics and are regarded to have a practical value, there still remain many problems in view of various performance requirements for photoreceptors. On the other hand, these photoreceptors, though depending on the end use or the method of production, generally show their excellent characteristics due to employing excellent photoconductive substances.

The inventors studied various photoconductive substances, and, as a result, found that certain kinds of hydrazone compounds are excellent as photoconductive substances for electrophotographic photoreceptors as described in Japanese Patent Publication No. 34099/85 and Japanese patent application (OPI) No. 163047/85.

It is also known that diarylamine compounds, particularly benzidine compounds, are excellent photoconductive substances for electrophotographic photoreceptors as taught in U.S. Pat. No. 3,265,495, Japanese patent publication No. 11546/64 and U.S. Pat. No. 4,265,990.

However, since the photoconductive substances, such as the above-described hydrazone compounds and benzidine compounds, are usually used in an amount of from 10 to 90% by weight, and preferably from 30 to 70% by weight, based on the total solid content of a photosensitive layer, when a photoreceptor is prepared by using only one kind of these compounds as a photoconductive substance, the hydrazone compound or benzidine compound is gradually crystallized in the photosensitive layer, to ultimately precipitate on the surface during long-term preservation or preservation under a high temperature condition, though such does not occur immediately after preparation. A photoreceptor having undergone such crystallization is of no practical use due to deterioration image quality, such as an uneven image, formation of white spots, and the like, upon toner image formation. Moreover, if the crystallization proceeds after formation of a toner image, crystals precipitate on image areas or the background to form stains, thus resulting in poor image preservability.

The above-described problem becomes more serious in particular cases where the photoreceptor is a transparent electrophotographic photoreceptor and is applied to use in which an image is required to be preserved for a very long period of time and is reproduced by an enlarging projection, such as use as a microfilm. Through enlargement of an image by projection, the crystals precipitated on the photoreceptor, even though being very minute, greatly reduce the image quality and reduce resolving power particularly required for microfilms, to make image information illegible, resulting in destruction of practical value.

When applied to microfilms, photoreceptors having formed images are expected to be preserved for more than 10 years, and are, therefore, strongly desired to have image stability sufficient for long-term preservation.

SUMMARY OF THE INVENTION

One object of this invention is to provide an electrophotographic photoreceptor which exhibits satisfactory preservability without precipitating crystals thereon even when preserved for a long period of time or under high temperature conditions, either before or after image formation.

Another object of this invention is to provide a transparent and flexible electrophotographic photoreceptor of a type intended to be subjected to image enlargement, such as a microfilm.

As a result of extensive investigations, the inventors have found that the above objects can be accomplished by an electrophotographic photoreceptor comprising a conductive support having provided thereon a photosensitive layer containing at least one hydrazone compound represented by formula (I) or (II) and at least one benzidine compound represented by formula (III).

Formula (I) is represented by

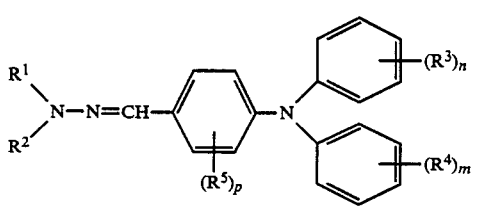

(I)

wherein $R^1$ and $R^2$ (which may be the same or different) each represents a substituted or unsubstituted, straight or branched chain alkyl group having from 1 to 12 carbon atoms, a substituted or unsubstituted, straight or branched chain aralkyl group having from 7 to 20 carbon atoms, or a substituted or unsubstituted monocyclic aryl group or a substituted or unsubstituted condensed polycyclic aryl group having from 2 to 4 rings; $R^3$, $R^4$ and $R^5$ each represents a hydrogen atom, a substituted or unsubstituted, straight or branched chain alkyl group having from 1 to 12 carbon atoms, a substituted or unsubstituted, straight or branched chain aralkyl group having from 7 to 20 carbon atoms, a straight chain or branched alkoxy group having from 1 to 4 carbon atoms, an aryloxy group, an acyl group, an alkoxycarbonyl group having from 2 to 5 carbon atoms, a halogen atom, a nitro group, a monoalkylamino group having from 1 to 4 carbon atoms in the alkyl group, a dialkylamino group having from 1 to 4 carbon atoms in each alkyl group, or an amido group; and n, m and p each represents 1 or 2.

Formula (II) is represented by (II)

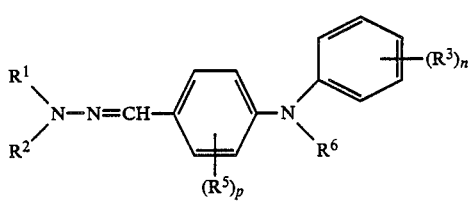

wherein $R^1$, $R^2$, $R^3$, $R^5$, n, and m are as defined above; and $R^6$ represents a substituted or unsubstituted, straight or branched chain alkyl group having from 1 to 12 carbon atoms or a substituted or unsubstituted, straight or branched chain aralkyl group having from 1 to 12 carbon atoms.

Formula (III) is represented by (III)

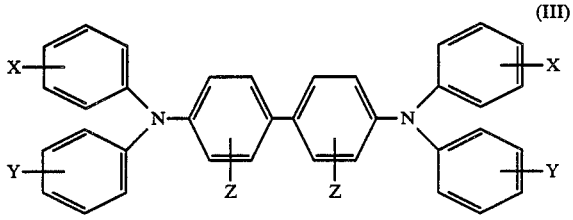

wherein X and Y (which may be the same or different) each represents a hydrogen atom, an alkyl group having from 1 to 4 carbon atoms, or a halogen atom; and Z represents a hydrogen atom or an alkyl group having from 1 to 4 carbon atoms.

DETAILED DESCRIPTION OF THE INVENTION

In the above-described formulae (I) and (II), examples of the unsubstituted alkyl group as represented by $R^1$, $R^2$, $R^3$, $R^4$, or $R^5$ include a methyl group, an ethyl group, a propyl group, a butyl group, a pentyl group, a hexyl group, an octyl group, a nonyl group, a dodecyl group, an isopropyl group, an isobutyl group, an isopentyl group, a 4-methyl-pentyl group, a sec-butyl group, a t-butyl group, etc. When $R^1$, $R^2$, $R^3$, $R^4$, $R^5$, or $R^6$ is a substituted alkyl group, the substituent thereof is selected from a halogen atom, e.g., a chlorine atom, a bromine atom, and a fluorine atom; an alkoxy group, e.g., a methoxy group, an ethoxy group, a propoxy group, a butoxy group, and a pentyloxy group; an aryloxy group, e.g., a phenoxy group, an o-, m- or p-tolyloxy group, and a 1- or 2-naphthyloxy group; a dialkylamino group, e.g., a dimethylamino group, a diethylamino group, a dipropylamino group, an N-methyl-N-ethylamino group, an N-ethyl-N-propylamino group, and an N-methyl-N-propylamino group; and an alkylthio group, e.g., a methylthio group, an ethylthio group and a propylthio group.

Examples of the unsubstituted aralkyl group as represented by $R^1$, $R^2$, $R^3$, $R^4$, $R^5$, or $R^6$ include a benzyl group, a phenethyl group, a 1- or 2-naphthylmethyl group, a 1-anthrylmethyl group and a benzhydryl group. When $R^1$, $R^2$, m $R^3$, $R^4$, $R^5$, or $R^6$ represents a substituted aralkyl group, the substituent or substituents is or are selected from the same groups as enumerated for the substituted alkyl group.

The unsubstituted aryl group as represented by $R^1$ or $R^2$ includes a phenyl group, a 1- or 2-naphthyl group, an anthryl group, a pyrenyl group, an acenaphthenyl group and a fluorenyl group. When $R^1$ or $R^2$ represents a substituted aryl group, the substituent or substituents therefor is or are selected from the same groups as enumerated for the substituted alkyl group, and, in addition, an alkyl group, e.g., a methyl group, an ethyl group, a propyl group, a butyl group, a pentyl group, an isopropyl group, an isobutyl group, and an isopentyl group.

it is preferable that one of $R^1$ and $R^2$ represents a phenyl group, with the other representing a methyl group, an ethyl group, a benzyl group, or a phenyl group.

Examples of the straight chain or branched alkoxy group as represented by $R^3$, $R^4$, or $R^5$ include a methoxy group, an ethoxy group, a propoxy group, a butoxy group, an isopropoxy group, and a sec-butoxy group. Examples of the aryloxy group as represented by $R^3$, $R^4$, or $R^5$ include a phenoxy group, and an o-, m- or p-tolyloxy group. Examples of the acyl group as represented by $R^3$, $R^4$, or $R^5$ include an acetyl group, a propionyl group, a benzoyl group, and an o-, m- or p-toluoyl group. Examples of the alkoxycarbonyl group as represented by $R^3$, $R^4$, or $R^5$ include a methoxycarbonyl group, an ethoxycarbonyl group, a propoxycarbonyl group and a butoxycarbonyl group. Examples of the halogen atom as represented by $R^3$, $R^4$, or $R^5$ include a chlorine atom, a bromine atom, and a fluorine atom. The monoalkylamino group having an alkyl group containing from 1 to 4 varbon atoms includes a methylamino group, an ethylamino group, and a butylamino group. Examples of the dialkylamino group having alkyl groups containing from 1 to 4 carbon atoms include a dimethylamino group, a dibutylamino group, and a N-methyl-N-ethylamino group. Examples of the amido group include an acetamide group and a propionamido group.

$R^3$, $R^4$ and $R^5$ each preferably represents a hydrogen atom, a methyl group, or a methoxy group.

$R^6$ preferably represents a methyl group or an ethyl group.

Specific but non-limiting examples of the hydrazone compounds represented by formulae (I) and (II) are shown below.

(1)

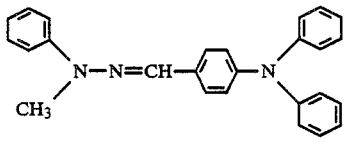

-continued
(2)
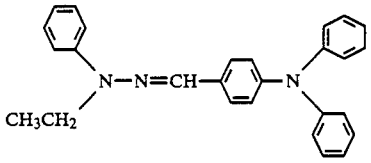
(3)
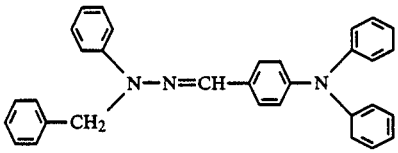
(4)
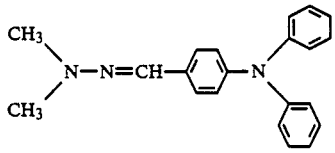
(5)
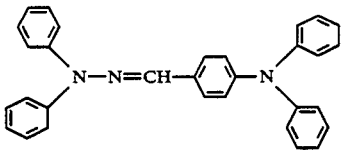
(6)
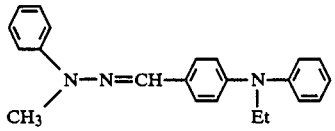
(7)
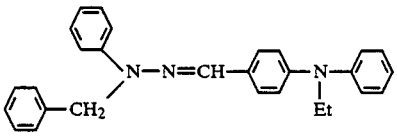
(8)
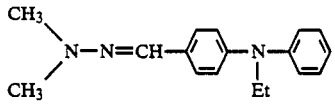
(9)
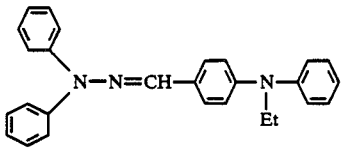
(10)
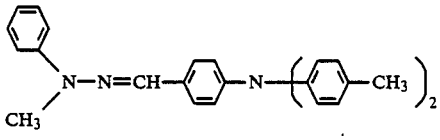
(11)
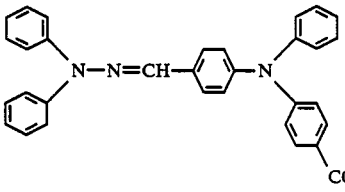
-continued
(12)
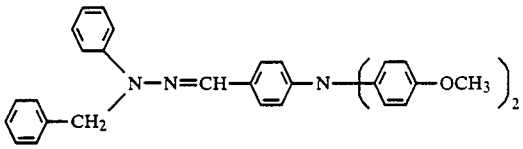
(13)
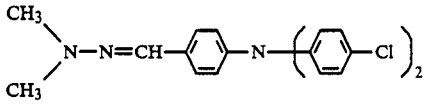
(14)
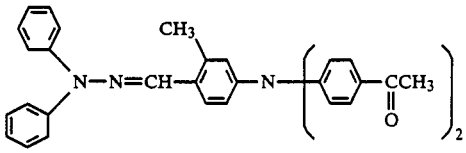
(15)
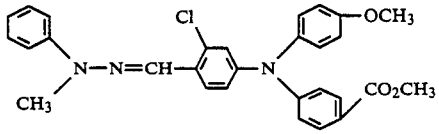
(16)
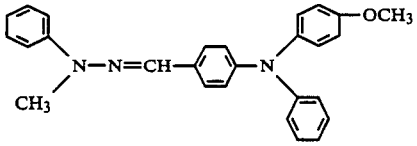
(17)
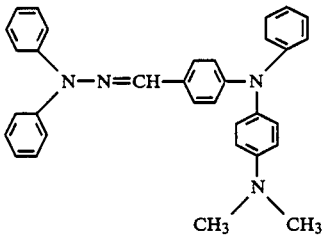
(18)
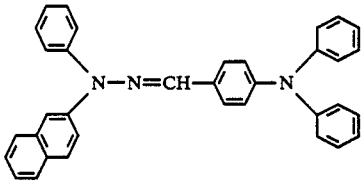
Specific but non-limiting examples of the benzidine compounds represented by formula (III) are shown below.
(19)
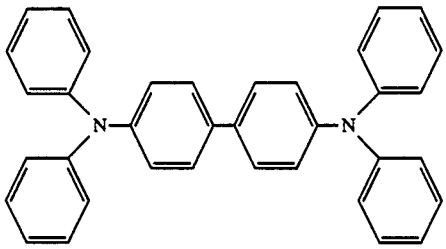

-continued (20)

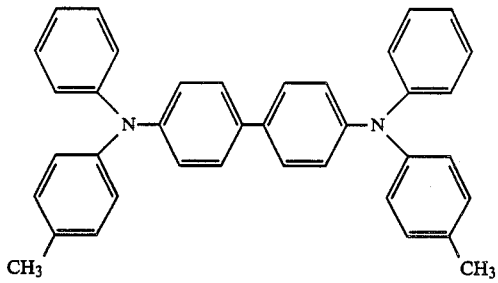

(21)

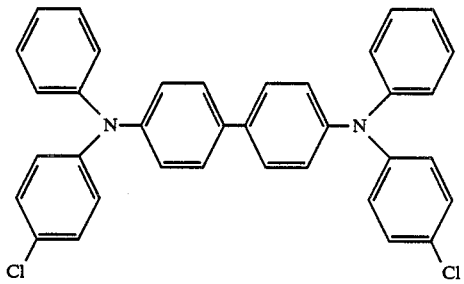

(22)

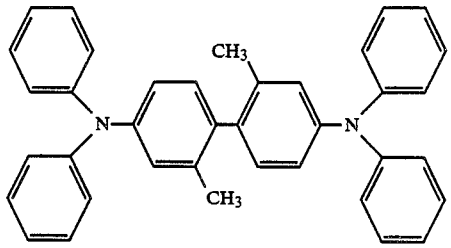

(23)

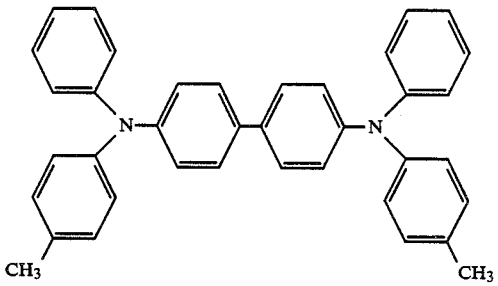

In the photoreceptors of the present invention, the hydrazone compound and the benzidine compound act as photoconductive substances, through which formation and movement of a charge carrier necessary for light decay can be carried out. However, since both of the hydrazone compound and benzidine compound have no substantial absorption in the visible region, it is necessary to sensitize these compounds by adding a sensitizer having absorption in the visible region when an image is formed with visible light.

Sensitizers which can be used for the photoreceptors of the present invention include triarylmethane dyes, e.g., Brilliant Green, Victoria Blue B, Methyl Violet, Crystal Violet, Acid Violet, etc.; xanthene dyes, e.g., Rhodamine B, Rhodamine 6G, Eosine S, Erythrocin, Rose Bengale, Fluoresceine, etc.; thiazine dyes, e.g., Methylene Blue, etc.; cyanine dyes, e.g., cyanine, etc.; pyrylium dyes, e.g., 2,6-diphenyl-4-(N,N-dimethylaminophenyl)thiapyrylium perchlorate, benzopyrylium salts as described in Japanese patent publication No. 25658/73, etc.; styryl dyes, such as those described in Japanese patent application (OPI) Nos. 163047/85 and 164588/84; and the like.

The photoreceptors according to the present invention can be produced by dissolving the hydrazone compound and benzidine compound in a solution of a binder and adding thereto, if necessary, a sensitizer to prepare a photosentitive coating composition, and coating the composition on a conductive support, followed by drying.

The thickness of the photosensitive layer is from 3 to 50 μm, and preferably from 5 to 20 μm. The hydrazone compound and benzidine compound are used in a total amount of from 10 to 90% by weight, and preferably from 20 to 60% by weight, based on the total solids content of the photosensitive layer. The weight proportion of the hydrazone compound to the benzidine compound ranges from 1/9 to 9/1, and preferably from 3/7 to 7/3.

The sensitizer to be used for imparting visible light sensitivity is generally used in an amount of from 0.05 to 20% by weight, and preferably from 0.1 to 5% by weight, based on the total solids content of the photosensitive layer.

Binders which can be used in the photoreceptors include condensed resins, such as polyamide, polyurethane, polyester, epoxy resins, polyketone, polycarbonate, etc., and vinyl polymers, such as polystyrene, polyacrylates, polymethacrylates, polyacrylamide, poly-N-vinylcarbazole, etc. In addition, any of electrically insulating resins can also be employed.

The photoreceptors of the present invention can further contain a plasticizer in addition to the binder. Examples of the plasticizers to be used include biphenyl, biphenyl chloride, o-terphenyl, p-terphenyl, diethyl phthalate, dibutyl phthalate, dioctyl phthalate, dibutyl sebacate, dioctyl sebacate, benzophenone, dimethylnaphthalene, and the like.

The photoreceptors may contain additives for increasing electrophotographic sensitivity, such as those described in Japanese patent application (OPI) Nos. 64539/83, 102239/83, and 102240/83.

For the purpose of stabilizing coating of a photosensitive layer and improving coating surface properties, additives, such as surface active agents, may also be used.

Conductive supports which can be used in the present invention may be any of materials having a visible light transmittance of at least 50% and preferably at least 70%, and having an electrically conductive surface. Such supports can be formed, for example, by vacuum-depositing a metal or metal oxide, e.g., palladium, gold, indium oxide, tin oxide, etc., on a plastic film, or coating such a metal or metal oxide together with a binder on a plastic film.

An adhesive layer or a blocking layer may be provided between the conductive support and the photosensitive layer in order to improve adhesion therebetween. Further, a protective layer may also be formed on the surface of the photoreceptors.

As described above, the photoreceptors according to the present invention contain both the hydrazone compound and the benzidine compound in the same photosensitive layer. As compared with those containing each of the hydrazone compound represented by formula (I) or (II) and the benzidine compound represented by formula (III) individually, progress of crystallization of the photoconductive substance is markedly retarded to greatly reduce deposition of crystals on surfaces of the photoreceptors when preserved for a long period of time or under high temperature, as is shown in the Examples set forth below. Accordingly, the photoreceptors of the invention exhibit notably improved preservability per se, and also improved preservability of images formed thereon.

Furthermore, the above-described improvement in image preservability and photoreceptor preservability can be achieved without accompanying impairment of electrophotographic characteristics of photoreceptors, such as sensitivity, dark decay, and the like, by adding a combination of the hydrazone compound of formula (I) or (II) and the benzidine compound of formula (III) to a photoconductive layer. As a result, the present invention makes it possible to produce a transparent electrophotographic photoreceptor having improved preservation stability as well as electrophotographic characteristics sufficient to be applied to practical use, thus increasing reliability of the transparent electrophotographic photoreceptor.

The above-mentioned effect on prevention of crystallization is thought to be ascribable to the following reason, although applicants do not assume to be bound thereby. Both the hydrazone compounds of formula (I) or (II) and the benzidine compounds of formula (III) carry an arylamine or triarylamine type skeleton, and are, therefore, regarded to bear a structural resemblance to each other but not a complete structural agreement. Therefore, these two types of compounds show compatibility with each other and are present in photoreceptors in such a state that they are mutually dissolved, while aggregation among molecules of the same compound is inhibited, to thereby prevent crystallization. To the contrary, if two compounds having extremely poor compatibility with each other are used in combination, these compounds are hardly mixed, rather resulting in acceleration of aggregation among the same compound.

This invention will now be illustrated in greater detail with reference to the following examples, but it should be understood that they are not intended to limit the present invention.

EXAMPLE 1

Three grams of Compound (5) as a hydrazone compound, 3 g of Compound (20) as a benzidine compound, $1\times10^{-4}$ mol of a thiopyrylium salt dye of the following formula (A) as a sensitizer, and 10 g of polycarbonate ("LEXAN 121", produced by G.E. Co.) as a binder were dissolved in a mixed solvent of 60 ml of methylene chloride and 20 ml of ethylene chloride to prepare a photosensitive composition.

(A)

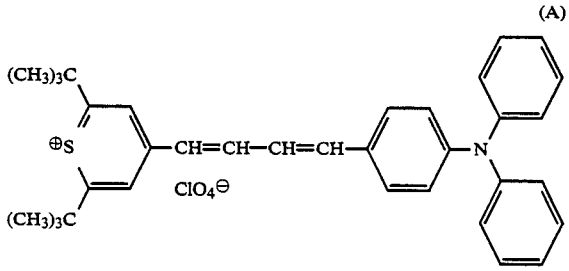

The photosensitive composition was coated on a 100 μm thick polyethylene terephthalate film having a palladium deposited film thereon (a thickness of 30 Å, formed by sputtering), with a wire bar, and dried to form an electrophotographic photosensitive layer. The resulting transparent electrophotographic film was designated as Sample No. 1.

EXAMPLE 2

A transparent electrophotographic film (Sample No. 2) was prepared in the same manner as described in Example 1, except for using Compound (1) in place of Compound (5).

EXAMPLE 3

A transparent electrophotographic film (Sample No. 3) was prepared in the same manner as described in Example 1, except for using Compound (18) in place of Compound (5).

EXAMPLE 4

A transparent electrophotographic film (Sample No. 4) was prepared in the same manner as described in Example 1, except for using Compound (19) in place of Compound (20).

EXAMPLE 5

A transparent electrophotographic film (Sample No. 5) was prepared in the same manner as described in Example 1, except for using Compound (22) in place of Compound (20).

COMPARATIVE EXAMPLE 1

A transparent electrophotographic film (Sample No. 6) was prepared in the same manner as described in Example 1, except for using 6 g of the hydrazone compound (Compound (5)) alone instead of 3 g of Compound (20) and 3 g of Compound (5).

COMPARATIVE EXAMPLE 2

A transparent electrophotographic film (Sample No. 7) was prepared in the same manner as described in Example 1, except for using 6 g of the benzidine compound (Compound (20)) alone instead of 3 g of Compound (20) and 3 g of Compound (5).

Each of the resulting electrophotographic films (Sample Nos. 1 to 7) was preserved at 50° C. for 1 month, or at 50° C. for 3 months, and precipitation of crystals on its surface was observed under 50 times enlargement by a reflection microscope through a polarized light filter. The results are shown in Table 1 below.

It is apparent from Table 1 that the problem of crystallization can be eliminated by the present invention. When each of the long-term preserved Sample Nos. 6 and 7 was charged at +600 V by corona discharge, imagewise exposed to light, and developed with a liquid developer ("Ricoh MRP", produced by Ricoh Company Ltd.), the developed image suffered uneven density and white spots. On the other hand, when Sample Nos. 1 to 5 were processed in the same manner as described above, images free from uneven density and white spots were obtained.

Then, in order to evaluate electrophotographic characteristics, each of the electrophotographic films was electrostatically charged at +7.5 KV by corona discharge, and then exposed to light at an illuminance of 4 lux by the use of a copying paper testing apparatus (Model SP-248, manufactured by Kawaguchi Denki K.K.). Photosensitivity was determined by obtaining an exposure $E_{50}$ (lux·sec) required for half light decay. Electric charge retention was determined by measuring the potential in dark after 60 seconds from the corona charging to obtain a percentage of retention of the initial potential.

The results obtained are shown in Table 1.

TABLE 1

| Sample No. | Precipitation of Crystals 50° C. 1 month | Precipitation of Crystals 50° C. 3 months | Electrophotographic Properties $E_{50}$ (lux · sec) | Electrophotographic Properties Percentage of Charge Retention (%) | Remark |
|---|---|---|---|---|---|
| 1 | none | none | 150 | 90 | Invention |
| 2 | " | " | 167 | 90 | " |
| 3 | " | " | 150 | 85 | " |
| 4 | " | " | 162 | 88 | " |
| 5 | " | " | 158 | 90 | " |
| 6 | precipitated | precipitated | 164 | 89 | Comparison |
| 7 | precipitated | precipitated | 154 | 92 | " |

It can be seen from Table 1 that the present invention makes it possible to obtain transparent electrophotographic photoreceptors having satisfactory stability and image preservability and freedom from precipitation of crystals on the surface thereof without impairing electrophotographic characteristics.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a conductive support having provided thereon a photosensitive layer containing at least one hydrazone compound represented by formula (I) or (II)

(I)

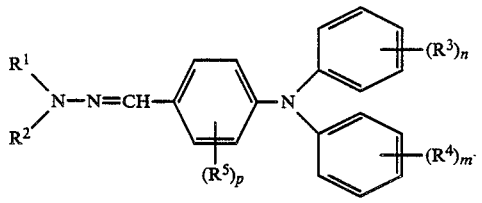

(II)

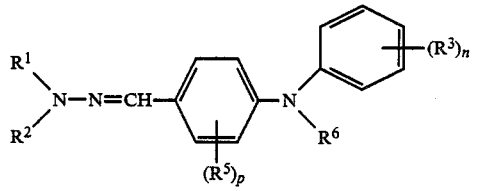

wherein $R^1$ and $R^2$ each represents an alkyl group selected from the group consisting of a methyl group, an ethyl group, a propyl group, a butyl group, a pentyl group, a hexyl group, an octyl group, a nonyl group, a dodecyl group, an isopropyl group, an isobutyl group, an isopentyl group, a 4-methyl-pentyl group, a sec-butyl group and a t-butyl group, or an aralkyl group selected from the group consisting of a benzyl group, a phenethyl group, a 1- and 2-naphthylmethyl groups, a 1-anthrylmethyl group and a benzhydryl group, or a substituted or unsubstituted aryl group selected from the group consisting of phenyl group, a 1- and 2-naphthyl groups, an anthryl group, a pyrenyl group, an acenaphthenyl group and a fluorenyl group; $R^3$, $R^4$, and $R^5$ each represents a hydrogen atom, a substituted or unsubstituted, straight or branched chain alkyl group having from 1 to 12 carbon atoms, a substituted or unsubstituted, straight or branched chain aralkyl group having from 7 to 20 carbon atoms, a straight or branched chain alkoxy group having from 1 to 4 carbon atoms, an aryloxy group, an acyl group, an alkoxycarbonyl group having from 2 to 5 carbon atoms, a halogen atom, a nitro group, a monoalkylamino group having from 1 to 4 carbon atoms in the alkyl group, a dialkylamino group having from 1 to 4 carbon atoms in each alkyl group, or an amido group; $R^6$ represent a substituted or unsubstituted, straight or branched chain alkoxy group having from 1 to 12 carbon atoms or a substituted or unsubstituted, straight or branched chain aralkyl group having from 1 to 12 carbon atoms; and n, m, and p each represents 1 or 2, and at least one benzidine compound represented by formula (III)

(III)

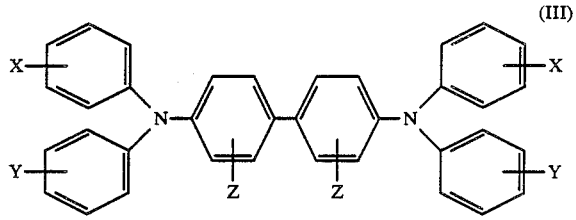

wherein X and Y each represents a hydrogen atom, an alkyl group having 1 to 4 carbon atoms, or a halogen atom; and Z represents a hydrogen atom or an alkyl group having from 1 to 4 carbon atoms.

2. An electrophotographic photoreceptor as in claim 1, wherein the substituent of the substituted alkyl or aralkyl group as represented by $R^1$, $R^2$, $R^3$, $R^4$, or $R^5$ is selected from a halogen atom, an alkoxy group, an aryloxy group, a dialkylamino group and an alkylthio group, and the substituent of the substituted aryl group as represented by $R^1$ or $R^2$ is selected from a halogen atom, an alkoxy group, an aryloxy group, a dialkylamino group, an alkylthio group, and an alkyl group.

3. An electrophotographic photoreceptor as in claim 1, wherein one of $R^1$ and $R^2$ represents a phenyl group, and the other represents a methyl group, an ethyl group, a benzyl group, or a phenyl group.

4. An electrophotographic photoreceptor as in claim 1, wherein $R^3$, $R^4$, and $R^5$ each represents a hydrogen atom, a methyl group, or a methoxy group.

5. An electrophotographic photoreceptor as in claim 1, wherein $R^6$ represents a methyl group or an ethyl group.

6. An electrophotographic photoreceptor as in claim 1, wherein said hydrazone compound or compounds and said benzidine compound or compounds are present in a total amount of from 10 to 90% by weight based on the total solids content of the photosensitive layer.

7. An electrophotographic photoreceptor as in claim 6, wherein said hydrazone compound or compounds and said benzidine compound or compounds are present in a total amount of from 20 to 60% by weight based on the total solid content of the photosensitive layer.

8. An electrophotographic photoreceptor as in claim 1, wherein the weight ratio of said hydrazone compound or compounds to said benzidine compound or compounds is from 1/9 to 9/1.

9. An electrophotographic photoreceptor as in claim 8, wherein the weight ratio of said hydrazone compound or compounds to said benzidine compound or compounds is from 3/7 to 7/3.

10. An electrophotographic photoreceptor as in claim 1, wherein said photosensitive layer further contains a sensitizer.

11. An electrophotographic photoreceptor as in claim 10, wherein said sensitizer is present in an amount of from 0.05 to 20% by weight based on the total solids content of the photosensitive layer.

12. An electrophotographic photoreceptor as in claim 11, wherein said sensitizer is present in an amount of from 0.1 to 5% by weight based on the total solids content of the photosensitive layer.

13. An electrophotographic photoreceptor as in claim 1, wherein said conductive support has a visible light transmittance of at least 50%.

* * * * *